US010894685B2

(12) United States Patent
Yoda et al.

(10) Patent No.: US 10,894,685 B2
(45) Date of Patent: Jan. 19, 2021

(54) SHEET COLLECTION DEVICE, SHEET COLLECTION SYSTEM, SHEET COLLECTION METHOD

(71) Applicant: SEIKO EPSON CORPORATION, Tokyo (JP)

(72) Inventors: Kaneo Yoda, Nagano (JP); Seiichi Taniguchi, Asahi-mura (JP)

(73) Assignee: Seiko Epson Corporation, Tokyo (JP)

( * ) Notice: Subject to any disclaimer, the term of this patent is extended or adjusted under 35 U.S.C. 154(b) by 38 days.

(21) Appl. No.: 16/078,816

(22) PCT Filed: Feb. 6, 2017

(86) PCT No.: PCT/JP2017/004235

§ 371 (c)(1),
(2) Date: Aug. 22, 2018

(87) PCT Pub. No.: WO2017/145727

PCT Pub. Date: Aug. 31, 2017

(65) Prior Publication Data

US 2019/0047814 A1 Feb. 14, 2019

(30) Foreign Application Priority Data

Feb. 24, 2016 (JP) ..... 2016-032757

(51) Int. Cl.

| | |
|---|---|
| ***B65H 33/14*** | (2006.01) |
| ***B65H 31/24*** | (2006.01) |
| ***B65H 43/08*** | (2006.01) |
| ***B65F 5/00*** | (2006.01) |
| ***B07C 5/34*** | (2006.01) |
| ***B07C 5/38*** | (2006.01) |

(Continued)

(52) U.S. Cl.

CPC ..... *B65H 33/14* (2013.01); *B07C 5/34* (2013.01); *B07C 5/38* (2013.01); *B65F 5/00* (2013.01);

(Continued)

(58) Field of Classification Search

CPC ..... B65H 33/14; B65H 43/00; B65H 29/46; B07C 5/34; G07D 11/0084; G07D 11/00; G07D 11/50

See application file for complete search history.

(56) References Cited

U.S. PATENT DOCUMENTS 8,186,672 B2 * 5/2012 Mackenzie ..... B65H 29/46 271/176
8,544,656 B2 * 10/2013 Mennie ..... G07D 11/40 209/534

(Continued)

FOREIGN PATENT DOCUMENTS

JP 09-295748 A 11/1997
JP 2002-182518 A 6/2002

(Continued)

*Primary Examiner* — Thomas A Morrison

(74) *Attorney, Agent, or Firm* — Global IP Counselors, LLP

(57) ABSTRACT

A sheet collection device includes a discrimination portion that discriminates the type of sheet, a plurality of containers that store sheets, a transport portion that transports the sheets to any one container from among the plurality of containers based on the discrimination result by the discrimination portion, an accumulation portion that accumulates progress information of a storage amount of sheets in the container, and a notification portion that predicts a time at which the storage amount of the sheets that are stored in the containers based on the progress information reaches a first predetermined amount and notifies the predicted time to a terminal device.

5 Claims, 15 Drawing Sheets

(51) Int. Cl.
*B65H 29/12* (2006.01)
*B65H 43/06* (2006.01)

(52) U.S. Cl.
CPC ..... *B65H 29/125* (2013.01); *B65H 31/24* (2013.01); *B65H 43/06* (2013.01); *B65H 43/08* (2013.01); *B07C 2501/0054* (2013.01); *B65H 2408/111* (2013.01); *B65H 2511/30* (2013.01); *B65H 2511/416* (2013.01); *B65H 2513/53* (2013.01); *B65H 2553/40* (2013.01); *B65H 2557/64* (2013.01); *B65H 2801/06* (2013.01)

(56) References Cited

U.S. PATENT DOCUMENTS

| | | | | |
|---|---|---|---|---|
| 2002/0071688 | A1 | 6/2002 | Maruyama | |
| 2003/0194251 | A1 | 10/2003 | Maruyama et al. | |
| 2003/0197866 | A1 | 10/2003 | Uemura et al. | |
| 2008/0029953 | A1* | 2/2008 | Mackenzie ..... | B65H 29/46 271/207 |
| 2014/0027355 | A1* | 1/2014 | Kumagai ..... | G07D 11/50 209/534 |

FOREIGN PATENT DOCUMENTS

| | | | |
|---|---|---|---|
| JP | 2002-274602 | A | 9/2002 |
| JP | 2003-071308 | A | 3/2003 |
| JP | 2003-302208 | A | 10/2003 |
| JP | 2003-315260 | A | 11/2003 |
| JP | 2004-107030 | A | 4/2004 |
| JP | 2005-041664 | A | 2/2005 |
| JP | 2012-131597 | A | 7/2012 |

* cited by examiner

SHEET COLLECTION DEVICE, SHEET COLLECTION SYSTEM, SHEET COLLECTION METHOD

CROSS-REFERENCE TO RELATED APPLICATIONS

This application is a U.S. National stage application of International Patent Application No. PCT/JP2017/004235, filed on Feb. 6, 2017, which claims priority under 35 U.S.C. § 119(a) to Japanese Patent Application No. 2016-032757, filed in Japan on Feb. 24, 2016. The entire disclosure of Japanese Patent Application No. 2016-032757 is hereby incorporated herein by reference.

TECHNICAL FIELD

The present invention relates to a sheet collection device, a sheet collection system, and a sheet collection method.

BACKGROUND ART

In the related art, a confidential used paper collection and recycling system is known that connects to each other on a network a confidential document discharge side that discharges confidential documents as used paper, a shredding and transport processing side for shredding and transporting confidential documents having a shredding and transporting vehicle or the like while keeping the documents confidential, a paper recycling side that produces recycled paper while having equipment for dissolving and re-pulping shredded used paper, and a recycled product production side that produces various recycled products made from recycled paper, and centrally manages a schedule from discharge of confidential documents until production of recycled products and use (for example, refer to Japanese Unexamined Patent Application Publication No. 2005-41664).

Note that, it is necessary to sort discharged documents of each paper type in order to produce recycled paper that has stable quality. However, the system has a problem that the workload is increased or mis-sorting tends to occur since sorting of discharged used paper is performed by the worker himself.

SUMMARY

The invention is carried out in order to solve at least a part of the problem described above and can be realized in the following aspects or application examples.

[Application Example 1] According to this application example, there is a provided a sheet collection device having a discrimination portion that discriminates the type of sheet, a plurality of containers that store sheets, a transport portion that transports the sheets to any one container from among the plurality of containers based on the discrimination result by the discrimination portion, an accumulation portion that accumulates progress information of a storage amount of sheets in the containers, and a notification portion that predicts a time at which the storage amount of the sheets that are stored in the containers based on the progress information reaches a first predetermined amount and notifies the predicted time to a terminal device.

According to this configuration, it is possible to prevent occurrence of mis-sorting without the need for sorting by a worker since the sheets are sorted into each type and stored in the containers. In addition, it is possible to improve work efficiency since a prediction notification of the collection time of sheets that are stored in the containers is performed in a timely manner.

[Application Example 2] The sheet collection device according to the application example further having an initialization portion that initializes the storage amount of sheets that are stored in the containers, wherein the notification portion notifies the predicted time when initialization is carried out by the initialization portion.

According to this configuration, it is possible to know a subsequent collection timing and it is possible to increase worker efficiency when the storage amount of the sheets is initialized.

[Application Example 3] The sheet collection device according to the application example further having a measuring portion that measures that the storage amount of sheets that are stored in the containers reaches a second predetermined amount, wherein the notification portion notifies the predicted time when the storage amount of sheets that are stored in the containers reaches the second predetermined amount.

According to this configuration, it is possible to know a more accurate collection timing and it is possible to increase worker efficiency when the prediction notification is performed based on actual measurement by the measuring portion.

[Application Example 4] The sheet collection device according to the application example further having an accumulation portion that accumulates progress information of the storage amount of sheets in the containers for each type of sheet, and an allocation portion that allocates the type of the sheets that are stored respectively in the plurality of containers based on the progress information that is accumulated in the accumulation portion.

According to this configuration, it is possible to more efficiently perform a storage process of the sheets since an appropriate number of containers is allocated according to the storage amount of the sheets that are sorted into each type.

[Application Example 5] According to this application example, there is a provided a sheet collection system including the sheet collection device and a host device that is connected to the sheet collection device, in which the sheet collection device includes a discrimination portion that discriminates the type of sheet, a plurality of containers that store sheets, and a transport portion that transports the sheets to any one container from among the plurality of containers based on the discrimination result by the discrimination portion, and the host device includes an accumulation portion that accumulates progress information of a storage amount of sheets in the containers, and a notification portion that predicts a time at which the storage amount of the sheets that are stored in the containers based on the progress information reaches a first predetermined amount and notifies the predicted time to a terminal device.

According to this configuration, it is possible to prevent occurrence of mis-sorting without the need for sorting by a worker since the sheets are sorted into each type and stored in the containers. In addition, it is possible to improve work efficiency since a prediction notification of the collection time of sheets that are stored in the containers is performed in a timely manner.

[Application Example 6] According to this application example, there is a provided a sheet collection method including discriminating the type of sheet, transporting the sheets to any one container from among the plurality of containers that store the sheets based on the discrimination result, accumulating progress information of a storage amount of sheets in the containers, and predicting a time at which the storage amount of the sheets that are stored in the containers based on the progress information reaches a first predetermined amount and notifying the predicted time to a terminal device.

According to this configuration, it is possible to prevent occurrence of mis-sorting without the need for sorting by a worker since the sheets are sorted into each type and stored in the containers. In addition, it is possible to improve work efficiency since a prediction notification of the collection time of sheets that are stored in the containers is performed in a timely manner.

DESCRIPTION OF EMBODIMENTS

Figure 1:
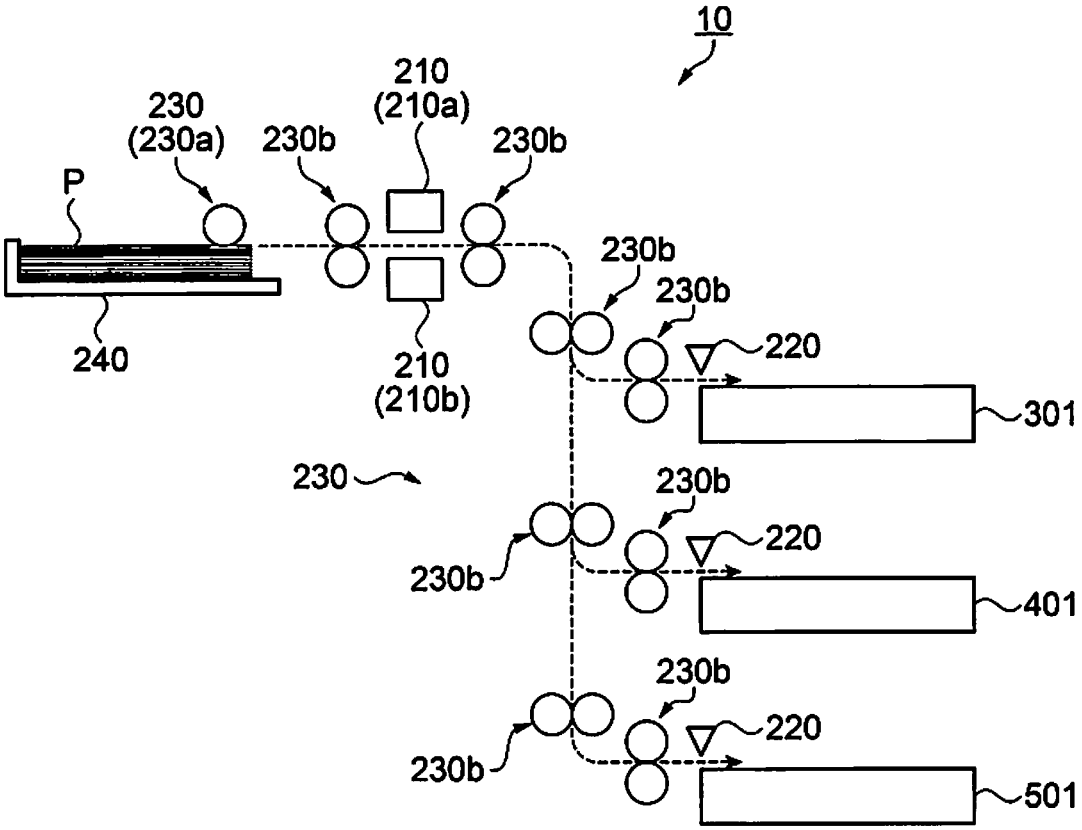
FIG. 1 is a schematic diagram illustrating a sheet collection device according to a first embodiment.

First to third embodiments of the present invention will be described below with reference to the drawings. Note that, in each of the drawings described below, the scale of each member and the like is indicated differently from the actual size in order for the sizes of each member and the like to be to the extent so as to be recognizable in the drawings.

First Embodiment

Figure 2:
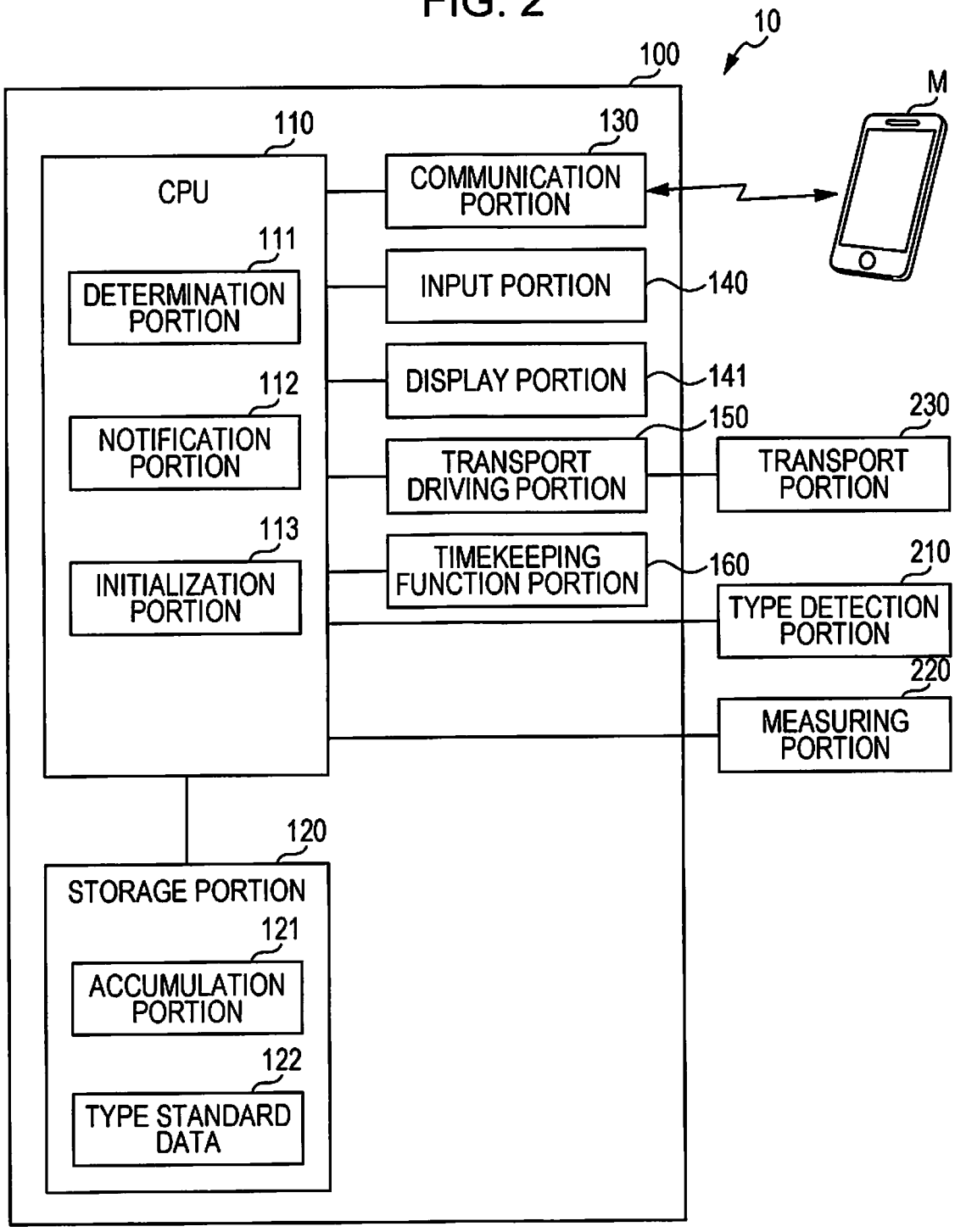
FIG. 2 is a block diagram illustrating a configuration of a control portion of the sheet collection device according to the first embodiment.

First, a sheet collection device will be described. FIG. 1 is a schematic diagram illustrating a configuration of the sheet collection device, and FIG. 2 is a block diagram illustrating a configuration of a control portion of the sheet collection device.

As shown in FIG. 1, a sheet collection device 10 is provided with a tray 240 in which sheets P are placed, a transport portion 230 that transports the sheets P from the tray 240, a type detection portion 210 that detects the type of the transported sheets P, a plurality (three in the embodiment) containers 301, 401, and 501 that store sheets P of each type, a measuring portion 220 that is provided in each container 301, 401, and 501, a control portion 100 (refer to FIG. 2), and the like.

The tray 240 is for placing the sheets P. The sheets P are waste paper or the like, and for example, are paper sheets of A4 size that is currently mainstream in offices, fine quality paper, carbon paper, vinyl coated paper, and the like. Note that, the embodiment describes a case where three kinds (types A, B, and C) of sheets P are transported from the tray 240 and are stored in each container 301, 401, and 501 of each type.

The transport portion 230 transports the sheets P from the tray 240 to each container 301, 401, and 501. The transport portion 230 is provided with a pickup roller 230*a* that transports the sheets P from the tray 240, a plurality of pairs of rollers 230*b* that transport the sheets P which are transported from the tray 240, and the like. The transport portion 230 is connected to the control portion 100 and is drivably controlled by the control portion 100. In the pair of rollers 230*b*, one is a driving roller and the other is a driven roller.

The type detection portion 210 detects the type of the transported sheets P. The type detection portion 210 is connected to the control portion 100. The type detection portion 210 is provided with a light-receiving element that receives reflected light from the sheets P (for example, a CCD sensor, a CMOS sensor, and the like). Then, there is a configuration in which the light-receiving element of the type detection portion 210 picks up an image as image information (detection data) of density contrast of the sheets P, and in the control portion 100, the type of the sheets P is discriminated in comparison with image information of the density contrast of each paper type as evaluation data prepared in advance. Note that, the type detection portion 210 is not limited to the abovementioned configuration, for example, may be configured such that the amount of transmitted light that is radiated on the sheets P is detected, and the type of the sheets P is discriminated based on the detected amount of transmitted light, and may be configured such that the spectrum of near infrared light that is reflected or absorbed by the sheets P is detected and the type of the sheets P is discriminated based on near infrared spectral analysis. Furthermore, there may be a configuration in which ultrasonic waves that are generated from the sheets P are received and the paper type of the sheets P is discriminated by carrying out frequency spectral analysis on the ultrasonic waves.

The type detection portion 210 is disposed on a transport path of the sheets P between the tray 240 and each container 301, 401, and 501. Note that, in the embodiment, the type detection portions 210 (210*a*, and 210*b*) are disposed so as to face both sides of the sheet P, respectively, and are configured to be able to detect each surface of the sheet P.

Each container 301, 401, and 501 stores the sheets P that are sorted in each type. For example, the sheets P that are determined to be type A are stored in the container 301. In addition, the sheets P that are determined to be type B are stored in the container 401, and the sheets P that are determined to be type C are stored in the container 501. Note that, the transport portion 230 is provided with a switching transport portion (not shown in the drawings) that switches the transport path of the sheets P in order to transport the sheets P to any of containers 301, 401, and 501 based on the discrimination of the type of the sheets P, and is drivably controlled by the control portion 100.

The measuring portion 220 is provided with each container 301, 401, and 501, and measures the number of passes of the sheets P in each container 301, 401, and 501. The measuring portion 220 is connected to the control portion 100. The measuring portion 220, for example, has a sensor and counter function that measure the number of passes of the sheet P, and for example, is provided with a projector that radiates light and a receiver that receives the radiated light, and it is possible to measure the number of sheets by detecting that the sheet P has passed by blocking light when the sheets P are transported between the projector and the receiver. Note that, the number of sheets of the sheets P that are transported to each of the containers 301, 401, and 501 may be counted by the control portion 100 without using the sensor. In addition, the measuring portion 220 may be configured by a sensor that detects that the storage amount of each container 301, 401, and 501, which will be described later, reaches the second predetermined amount.

Next, the configuration of the control portion 100 of the sheet collection device 10 will be described. As shown in FIG. 2, the control portion 100 is provided with a storage portion 120 in which a control program or the like is stored, a CPU 110 that executes the control program and controls each portion, a communication portion 130, an input portion 140, a display portion 141, a transport driving portion 150, a timekeeping function portion 160, and the like.

The input portion 140 is a key (button) kind for an input operation from a user. In addition, the display portion 141 displays various information. Note that, the input portion 140 and the display portion 141, may be configured, for example, to be integrally configured as a touch panel.

The communication portion 130 communicates with a terminal device M such as a personal computer or a mobile equipment. For example, information on the storage amount of the sheets P of each container 301, 401, and 501, prediction notification of the collection time of each container 301, 401, and 501, and the like is transmitted from the communication portion 130 toward the terminal device M.

The transport driving portion 150 drivably controls the transport portion 230 (driving roller of pickup roller 230*a*, and pair of rollers 230*b*) and the switching transport portion.

The timekeeping function portion 160 is provided with a stopwatch function that is able to measure the time, a calendar function that is able to measure the time and date, and the like.

In addition, the accumulation portion 121 is included in the storage portion 120. The accumulation portion 121 that accumulates progress information of the storage amount of sheets P in the containers 301, 401, and 501. Specifically, performing arithmetic processing of the number of sheets of the sheets P in the CPU 110 based on the measurement data that is measured by the measuring portion 220 that is disposed in each container 301, 401, and 501, and the calculation result is accumulated in the accumulation portion 121. At this time, information on the number of sheets (storage amount) of the sheets P with respect to time is accumulated by combining use of the stopwatch function and the calendar function of the timekeeping function portion 160.

In addition, the CPU 110 is provided with the discrimination portion 111. The discrimination portion 111 discriminates the type of sheet P. Specifically, the type of sheet P is determined based on the detection data by the type detection portion 210. The CPU 110 is able to sort the sheets P into each paper type by discriminating by comparing the detected data and the type standard data 122 that is tabulated for each type of predetermined sheet P.

In addition, the CPU 110 is provided with a notification portion 112 and performs notification creation process towards the terminal device M. The notification portion 112 predicts a time at which the storage amount of the sheets P that are stored in the containers 301, 401, and 501 based on the progress information of the storage amount of the sheets P of the accumulation portion 121 reaches a first predetermined amount and notifies the predicted time to the terminal device M. For example, the notification creation process is executed in accordance with the protocol (for example, simple mail transfer protocol (SMTP)) that is used in the transmission of electronic mail, post office protocol version 3 (POP3), and Internet message access protocol 4 (IMAP4), preset notification destination data is referenced, and the corresponding terminal device M is notified via the communication portion 130.

Electronic mail schedule notification is another electronic mail protocol with high convenience. When the user installs software that supports iCalendar (international standard RFC5545) at an Internet terminal, it is possible to register a predetermined date and time or notification which relates to sheet collection on user schedule management software via an electronic mail, and suggest future plans to users. Note that, in the example in FIG. 2, an example is indicated of being connected from the sheet collection device 10 to one (one device) terminal device M, but is not limited to this configuration, it is possible to communicate from the sheet collection device 10 toward a plurality of the terminal devices M.

Note that, the first predetermined amount is able to be appropriately set by a user such that the state of the containers 301, 401, and 501 is a predicted amount that is 100% (full) with respect to the storage amount that each container permits, a predicted amount that is 90% full with respect to the storage amount that the containers 301, 401, and 501 permit, a predicted amount of a predetermined number of days before the containers 301, 401, and 501 become full, or the like. Thereby, it is possible for the user to perform collection work at a suitable timing by receiving a notification at a time corresponding to the first predetermined amount.

In addition, the CPU 110 has an initialization portion 113, and for example, when the contents in the containers 301, 401, and 501 are collected (when the contents in the containers 301, 401, and 501 are empty), initializes the storage amount of the sheets P that are stored in the containers 301, 401, and 501 (for example, the number stored is set to 0). At this time, the timekeeping function portion 160 is reset and the time is set to zero. Then, the notification portion 112 notifies the predicted time when initialization is carried out by the initialization portion 113. For example, a notification is created that predicts the time at which the predicted amount that is 100% (full) with respect to the storage amount that the containers 301, 401, and 501 permit is reached, and a notification (transmission) is carried out to the terminal device M of the user. Thereby, the user is able to know the date and time of the subsequent collection schedule, and it is possible to increase work efficiency.

In addition, the notification portion 112 notifies the predicted time when the storage amount of sheets P that are stored in the containers 301, 401, and 501 reaches the second predetermined amount. That is, notification is carried out in which the collection time and date or the like is predicted when the second predetermined amount corresponding to the first predetermined amount is reached based on the actual measurement data. Specifically, based on the measurement data that is measured by the measuring portion 220, a case where the second predetermined amount is reached is notified, for example, a case where an amount of 90% full with respect to the storage amount that the containers 301, 401, and 501 permit is reached, a case where the sheets P reach the predetermined number of sheets, or the like. Note that, in the embodiment, the second predetermined amount is set to an amount of 100% (full) with respect to the storage amount that each container 301, 401, and 501 permits, and notification is made to the terminal device M in a case where the second predetermined amount is reached.

Figure 3:
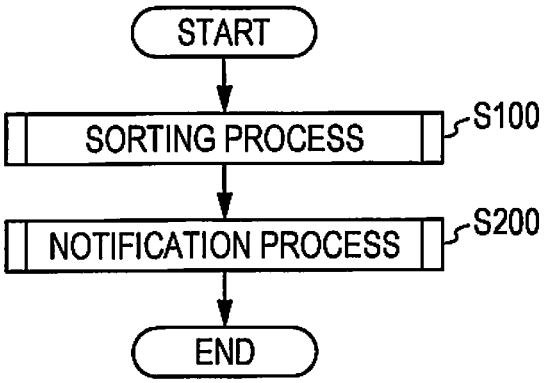
FIG. 3 is a flow chart illustrating a process configuration of the sheet collection device according to the first embodiment.

Next, a sheet collection method in the sheet collection device will be described. There is a sheet collection method for discriminating the type of sheet, transporting the sheets to any one container from among the plurality of containers that store the sheets based on the discrimination result, accumulating progress information of a storage amount of sheets in the container, and predicting a time at which the storage amount of the sheets that are stored in the container based on the progress information reaches a first predetermined amount and notifying the predicted time to a terminal device. Each process method according to the sheet collection method in the sheet collection device will be described. FIG. 3 is a flow chart illustrating a process configuration of the sheet collection device. As shown in FIG. 3, the sheet collection method is executed by a sorting process in step S100 and a notification process in step S200. The content in each process will be described below.

Figure 4:
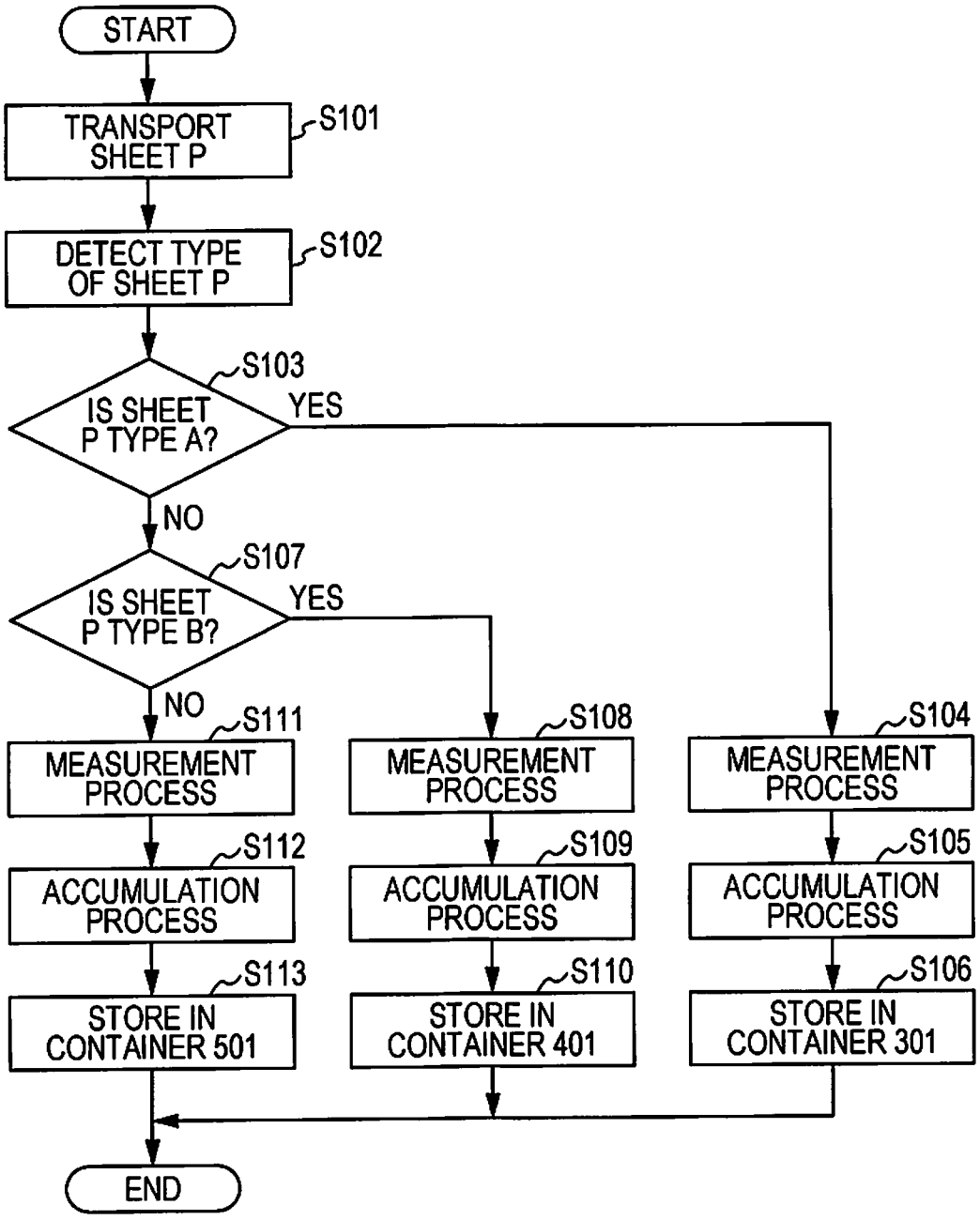
FIG. 4 is a flow chart illustrating a sorting function of the sheet collection device according to the first embodiment.

First, the sorting process of the sheets of the sheet collection device will be described. FIG. 4 is a flow chart illustrating a sorting process of the sheet collection device. Note that, the embodiment describes a sheet sorting function in a case where three kinds (types A, B, and C) of sheets P are transported from the tray 240.

As shown in FIG. 4, in step S101, transport of the sheets P is performed. Specifically, the pickup roller 230*a* is driven and the sheets P that are placed on the tray 240 are taken out from the tray 240. In addition, each of the pair of rollers 230*b* are driven and the sheets P are transported.

Next, in step S102, the type of the sheets P is detected. Specifically, the type detection portion 210 is driven and the transported sheets P are detected. Then, the detected detection data is transmitted to the control portion 100.

Next, in step S103, it is determined whether or not the sheets P are type A. Specifically, in the control portion 100, discrimination is made by comparing the detected detection data and the type standard data 122. Then, in a case where the sheets P are type A (YES), the process transitions to step S104. Meanwhile, in a case where the sheets P are not type A (NO), the process transitions to step S107.

In a case where the process transitions to step S104, the switching transport portion of the transport portion 230 is controlled and the sheets P are transported toward the container 301. Then, a measuring process is performed. Specifically, the measuring portion 220 is driven and the measurement data is acquired. The acquired measurement data is transmitted to the control portion 100.

Next, in step S105, an accumulation process is performed. Specifically, the transmitted measurement data is accumulated by the accumulation portion 121 as the progress information of the storage amount of the sheets P to the container 301. Thereby, the progress information in which the type A sheets P are associated with the container 301 is accumulated in the accumulation portion 121.

Next, in step S106, the sheets P are stored in the container 301. Thereby, the sheets P are sorted and stored as type A.

In addition, in a case where the process transitions to step S107, it is determined whether or not the sheets P are type B. Specifically, in the control portion 100, discrimination is made by comparing the detected detection data and the type standard data 122. Then, in a case where the sheets P are type B (YES), the process transitions to step S108. Meanwhile, in a case where the sheets P are not type B (NO), the process transitions to step S111.

In a case where the process transitions to step S108, the switching transport portion of the transport portion 230 controls and transports the sheets P toward the container 401. Then, a measuring process is performed. Specifically, the measuring portion 220 is driven and the measurement data is acquired. The acquired measurement data is transmitted to the control portion 100.

Next, in step S109, an accumulation process is performed. Specifically, the transmitted measurement data is accumulated by the accumulation portion 121 as the progress information of the storage amount of the sheets P to the container 401. Thereby, the progress information in which the type B sheets P are associated with the container 401 is accumulated in the accumulation portion 121.

Next, in step S110, the sheets P are stored in the container 401. Thereby, the sheets P are sorted and stored as type B.

In addition, in a case where the process transitions to step S111, the switching transport portion of the transport portion 230 controls and transports the sheets P toward the container 501. Then, a measuring process is performed. Specifically, the measuring portion 220 is driven and the measurement data is acquired. The acquired measurement data is transmitted to the control portion 100.

Next, in step S112, the accumulation process is performed. Specifically, the transmitted measurement data is accumulated by the accumulation portion 121 as the progress information of the storage amount of the sheets P to the container 501. Thereby, the progress information in which the type C sheets P are associated with the container 501 is accumulated in the accumulation portion 121.

Next, in step S113, the sheets P are stored in the container 501. Thereby, the sheets P are sorted and stored as type C.

Figure 5:
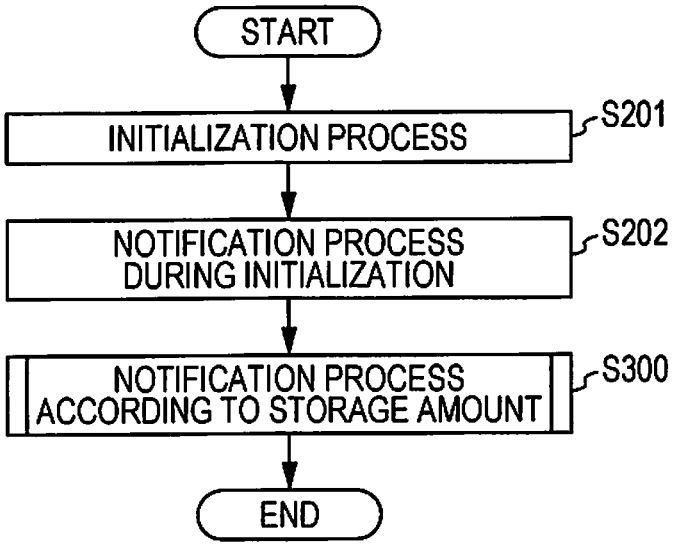
FIG. 5 is a flow chart illustrating the entire configuration of a notification function according to the first embodiment.

Next, a notification process of the sheet collection device will be described. FIG. 5 is a flow chart illustrating the entire configuration of the notification process.

As shown in FIG. 5, first, in step S201, an initialization process is executed. Specifically, when the sheets P are collected from the containers 301, 401, and 501 (when the sheets P stored in the containers 301, 401, and 501 are taken out by the user and the contents of the containers is empty), the storage amount of the sheets P (number of sheets of the sheets P) that are stored in the containers 301, 401, and 501 is initialized (set to 0 sheets). At this time, the timekeeping function portion 160 is reset and the time is set to zero.

Figure 6:
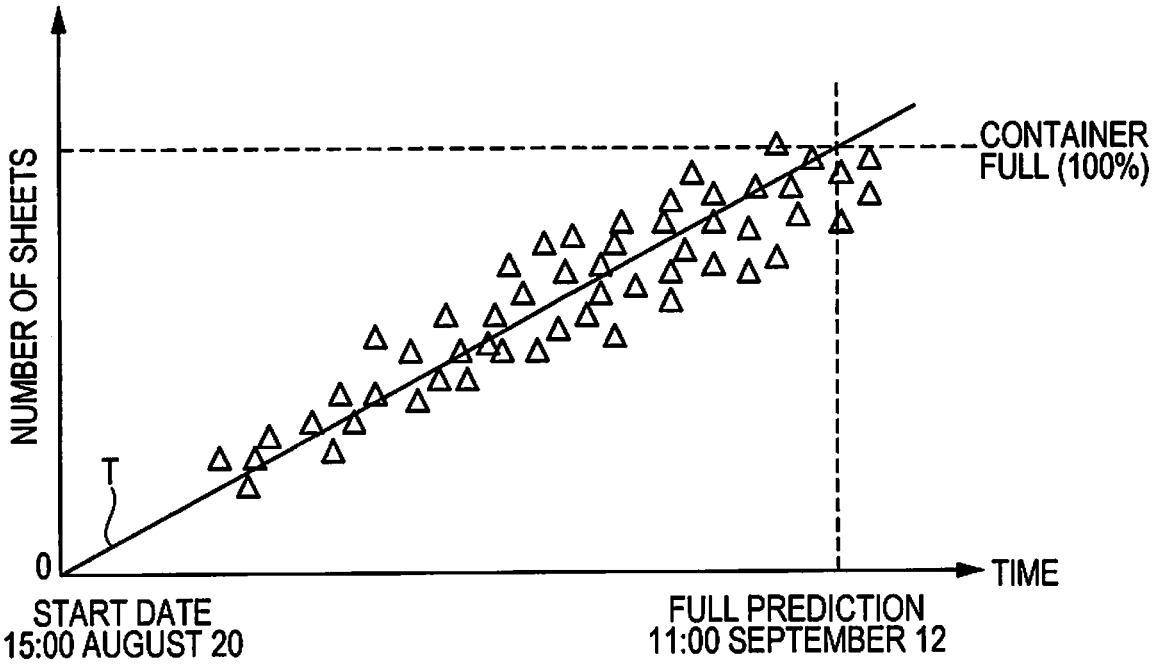
FIG. 6 is a schematic diagram illustrating a notification process during initialization according to the first embodiment.
Figure 7:
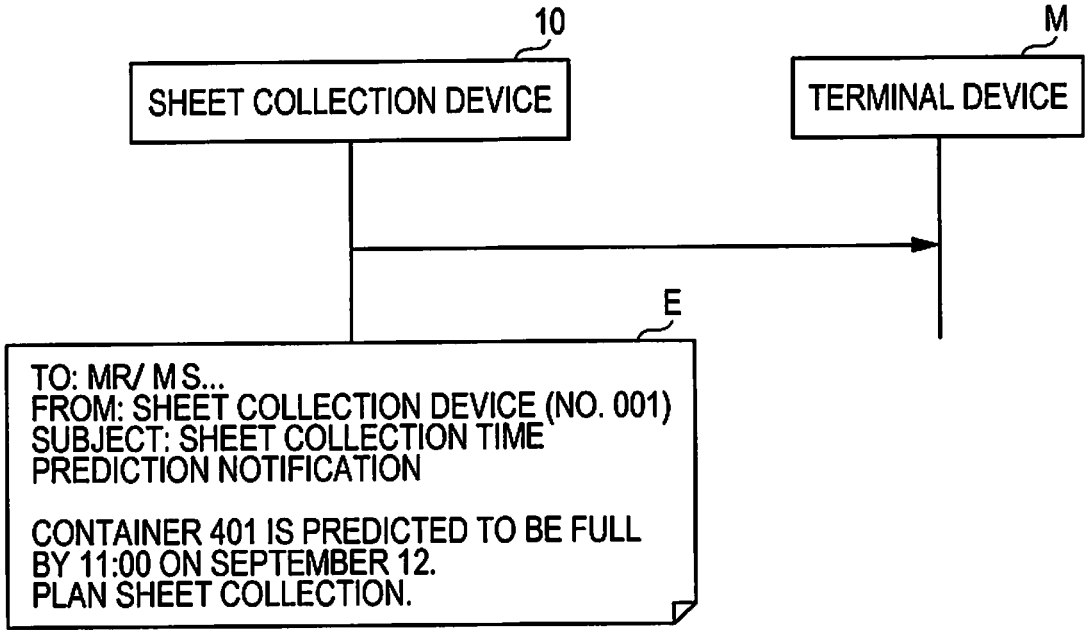
FIG. 7 is a schematic diagram illustrating a notification example of the notification process during initialization according to the first embodiment.

Next, in step S202, the notification process is executed during initialization. Specifically, a time at which the storage amount of the sheets P that are stored in the containers 301, 401, and 501 reaches the first predetermined amount is predicted and the predicted time is notified to the terminal device M. In the embodiment, the notification process is described in a case where the first predetermined amount is set to 100% (full) of the permitted amount of the container. FIG. 6 is a schematic diagram illustrating the notification process during initialization, and FIG. 7 is a schematic diagram illustrating a notification example of the notification process during initialization.

As shown in FIG. 6, when the initialization process is carried out, the date and time (the date and time of the subsequent collection) at which the subsequent first predetermined amount (full) is predicted based on accumulated data that was measured in the past. The accumulated data is progress information of the storage amount of the sheets P that are already accumulated in the accumulation portion 121. Note that, in the embodiment, the progress information ("A" in the drawings) of the type B sheets P is indicated. Then, in the prediction of the date and time of the subsequent collection date, a prediction line T that is a single regression line of linear function is calculated using single regression analysis of a general linear model based on the progress information of the accumulation portion 121. Then, the date and time that is calculated at an intersection point of the first predetermined amount and the prediction line T is calculated as a prediction date and time (date and time of the subsequent collection schedule). In the example in FIG. 6, the initialization process is executed at 15:00 on August 20, and the date and time of the subsequent collection schedule is 11:00 on September 12.

Then, a notification creation process to the terminal device M is performed. Specifically, as shown in FIG. 7, an electronic mail E in which an address, the sheet collection device 10 serving as a transmission source, a management number, and the date and time of the subsequent collection prediction are clearly specified is created in an electronic mail address of the user that is registered in the storage portion. Then, the created electronic mail E is notified (transmitted) to the terminal device M of the user. Thereby, the user is able to know the date and time of the subsequent collection schedule at an initialized stage, and it is possible to increase work efficiency. Note that, the content of the electronic mail E is able to be set, as appropriate.

Figure 8:
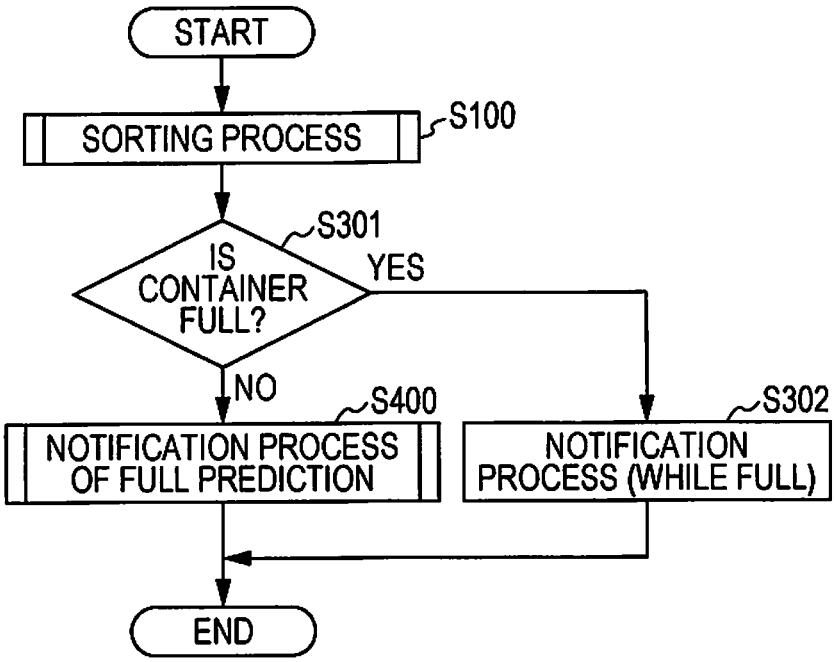
FIG. 8 is a flow chart illustrating the notification process according to the storage amount according to the first embodiment.

Next, the notification process according to the storage amount in step S300 will be described. FIG. 8 is a flow chart illustrating the notification process according to the storage amount. In the notification process according to the storage amount, a time at which the storage amount of the sheets P that are stored in the container 401 reaches the first predetermined amount is predicted and the predicted time is notified (prediction notification) to the terminal device M. Note that, the first predetermined amount of the embodiment is described in a case where the storage amount of the sheets P is 100% (container 401 is full), the storage amount of the sheets P is 90% (container 401 is 90% full), and the storage amount of the sheets P is a storage amount of 100% at the predetermined date before (storage amount of the sheets P in the embodiment is 100% four days before).

Then, the notification process (prediction notification) performs prediction analysis (single regression analysis) of the storage amount of the sheets P based on the progress information of the storage amount of the sheets P that are accumulated by the measuring process of the measuring portion 220 after the initialization process is carried out, and a prediction line T' (refer to FIG. 10) of the storage amount of the sheets P is calculated. Thereby, the first predetermined amount in the container 401 (the storage amount of the sheets P is 100% (container 401 is full), the storage amount of the sheets P is 90% (container 401 is 90% full), and the storage amount of the sheets P is a storage amount of 100% at the predetermined date before (storage amount of the sheets P in the embodiment is 100% four days before)) is calculated.

Then, when the actual measured value corresponding to each of the predicted first predetermined amounts reaches the second predetermined amount, that is, when the measurement data that is acquired by measuring portion 220 reaches the second predetermined amount that corresponds to each first predetermined amount, the electronic mail E that clearly specifies the predicted time is created and transmitted to the terminal device M of the user. Detailed description is made below. Note that, the inclination of a straight line of a prediction line T' changes according to the accumulation state of the actual measured data since the prediction line T' of the storage amount of the sheets P is calculated based on the actual measured data by the measuring portion 220.

As shown in FIG. 8, the notification process according to the storage amount is performed while the sorting process (refer to FIG. 4) is performed in step S100. Specifically, in step S301, it is determined whether or not the container 401 is full. Specifically, determination is made based on the progress information that is obtained from the accumulation process of the sheets P. Then, in a case where the container is full (YES), the process transitions to step S302, and in a case where the container is not full (NO), the process transitions to step S400, and the notification process of full predication is performed.

Figure 9:
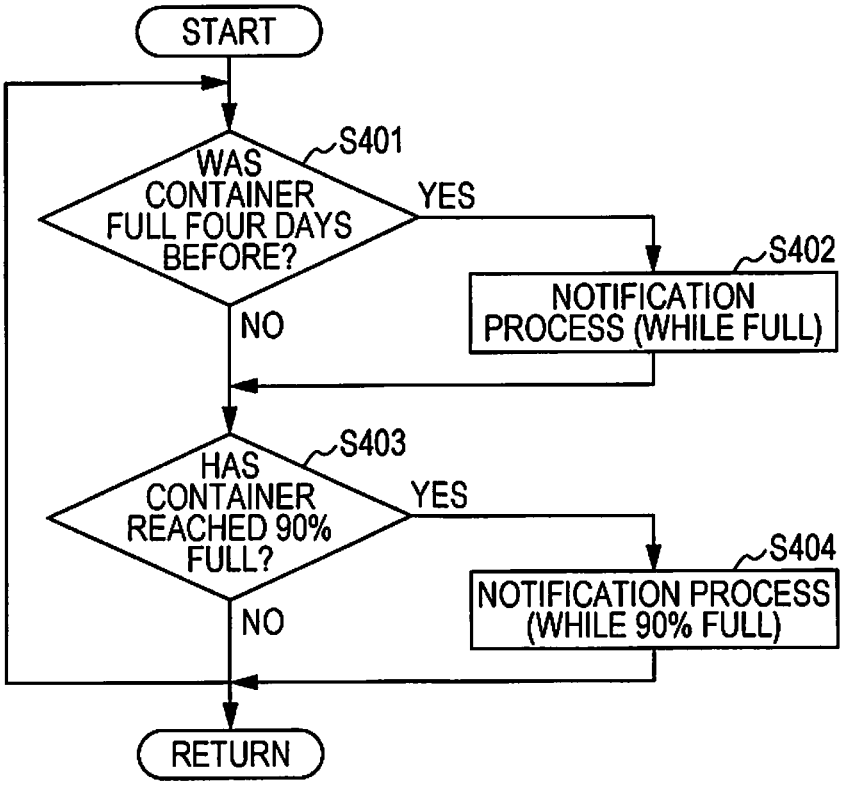
FIG. 9 is a flow chart illustrating the notification function in which the prediction time is notified according to the first embodiment.

Next, the notification process of full prediction in step S400 will be described. FIG. 9 is a flow chart illustrating the notification process in which the full prediction is notified.

Figure 10:
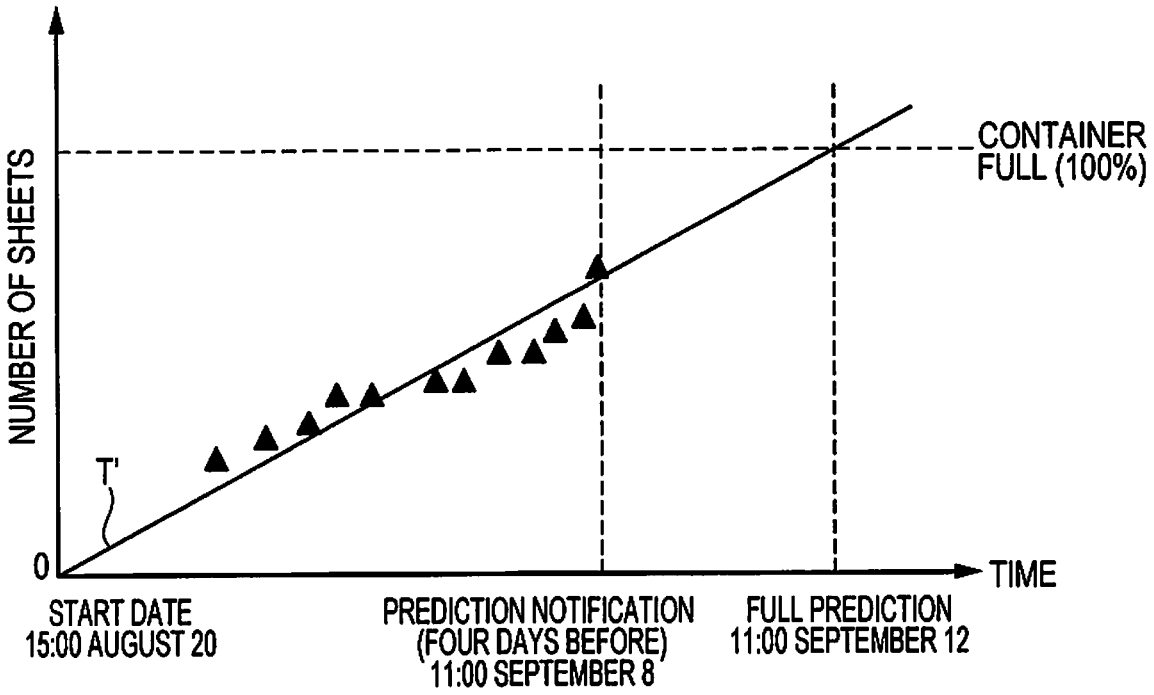
FIG. 10 is a schematic diagram illustrating a notification process (four days before) according to the first embodiment.

As shown in FIG. 9, in step S401, it is determined whether or not there is four days before the container 401 becomes full. That is, it is determined whether or not the storage amount four days before the container 401 becomes full is reached. FIG. 10 is a schematic diagram illustrating the notification process (four days before becoming full). As shown in FIG. 10, the determination is made based on the progress information of the accumulation portion 121 that accumulates the measurement data ("black triangle" in the drawings) that is acquired by the measuring portion 220 in the previous initialization process or later. Then, in a case where the storage amount four days before the container 401 becomes full is reached (YES), the process transitions to step S402, and in a case where the storage amount four days before the container 401 becomes full is not reached (NO), the process transitions to step S403.

Figure 11:
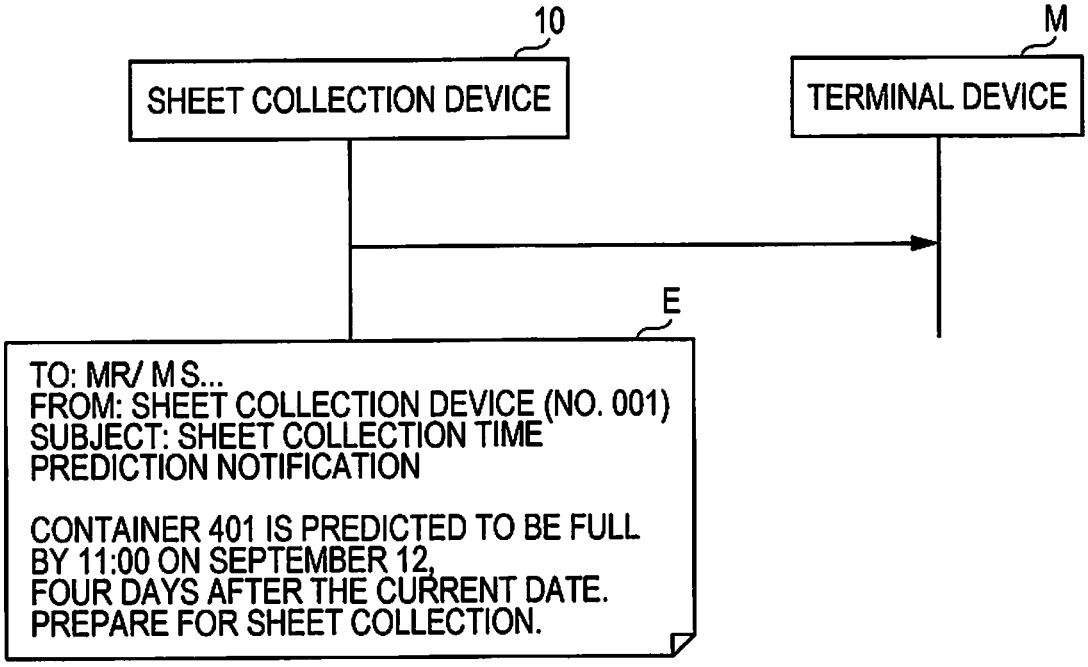
FIG. 11 is a schematic diagram illustrating a notification example of the notification process (four days before) according to the first embodiment.

In step S402, the notification process toward the terminal device M is executed in which four days before the container 401 becomes full is predicted. FIG. 11 is a schematic diagram illustrating the notification example of the notification process (four days before). As shown in FIG. 11, an electronic mail E in which an address, the sheet collection device 10 serving as a transmission source, a management number, and four days before the container 401 becomes full, that is, after four days is the day of the subsequent collection schedule are clearly specified is created in an electronic mail address of the user that is registered in the storage portion. Then, the created electronic mail E is notified (transmitted) to the terminal device M of the user. Thereby, the user is able to know the collection schedule day of the sheets P according to the container 401, and it is possible to increase work efficiency. Note that, the content of the electronic mail E is able to set, as appropriate.

Figure 12:
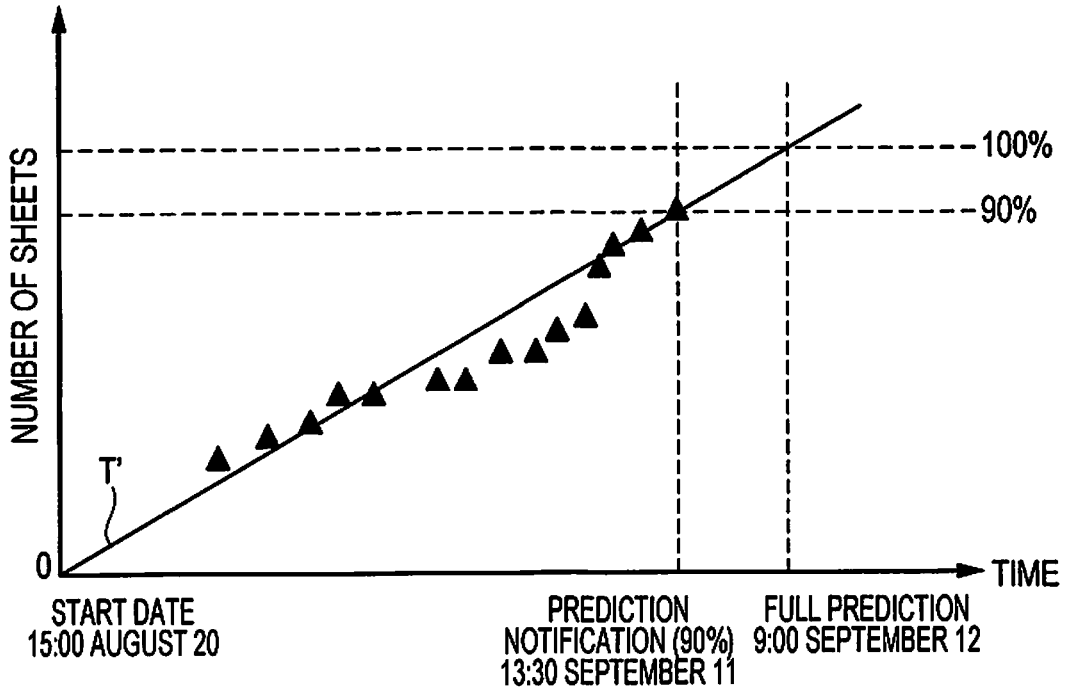
FIG. 12 is a schematic diagram illustrating a notification process (90% full) according to the first embodiment.

In addition, in a case where the process transitions to step S403, it is determined whether or not the container 401 reaches 90% full. FIG. 12 is a schematic diagram illustrating the notification process (90%). As shown in FIG. 12, the determination is made based on the progress information of the accumulation portion 121 that accumulates the measurement data ("black triangle" in the drawings) that is acquired by the measuring portion 220. In addition, the inclination of the prediction line T' changes based on the single regression analysis since the measurement data ("black triangle" in the drawings) is accumulated along with elapsed time. In the example in FIG. 12, the inclination is larger than the prediction line T' (refer to FIG. 10) that is used in the prediction notification four days before the container becomes full. This is because the growth rate of the storage amount of the sheets P in the container 401 is higher than the growth rate of the storage amount according to the elapsed time so far. Then, in a case where the container 401 reaches 90% full (YES), the process transitions to step S404, and in a case where the container 401 does not reach 90% full (NO), the process transitions to step S401, and thereafter, a loop process is performed until a predetermined instruction is given.

Figure 13:
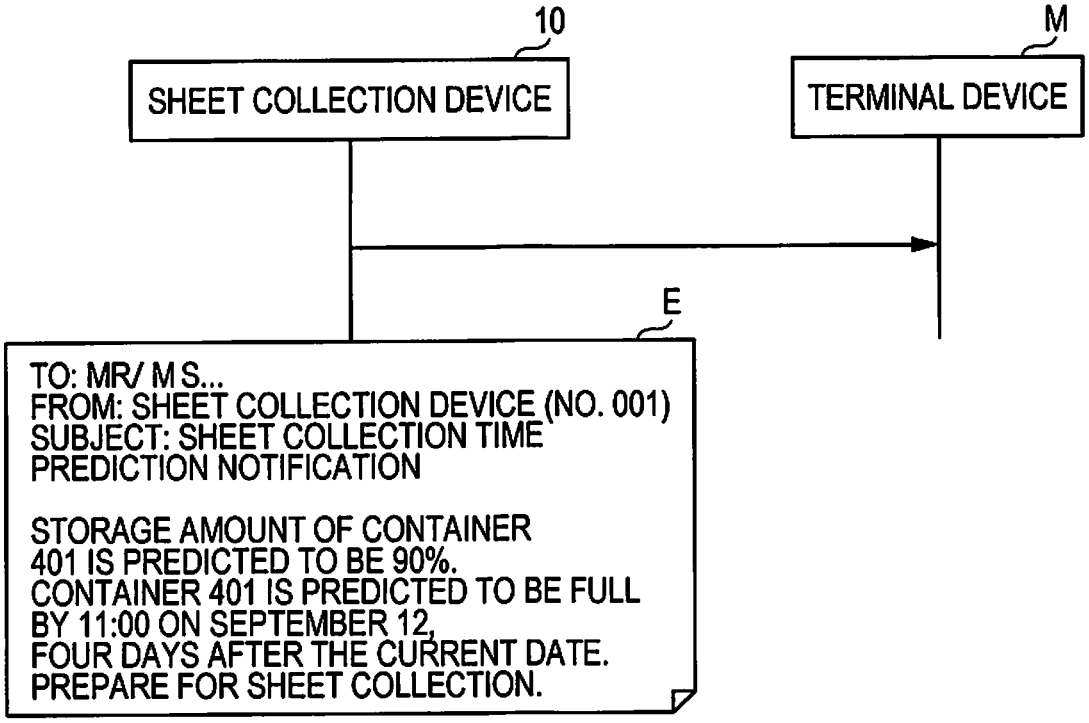
FIG. 13 is a schematic diagram illustrating a notification example of the notification process (90% full) according to the first embodiment.

In step S404, the notification process toward the terminal device M is executed in which the container 401 becomes 90% full. FIG. 13 is a schematic diagram illustrating the notification example of the notification process (90%). As shown in FIG. 13, an electronic mail E in which an address, the sheet collection device 10 serving as a transmission source, a management number, and the storage amount of the container 401 is 90% are clearly specified is created in an electronic mail address of the user that is registered in the storage portion. In addition, the date and time of the new collection schedule at the current time is also created in the electronic mail E. Then, the created electronic mail E is notified (transmitted) to the terminal device M of the user. Thereby, the user is able to know the date and time of the new collection schedule day of the sheets P along with the state of the storage amount of the sheets P in the container 401, and it is possible to increase work efficiency.

Figure 14:
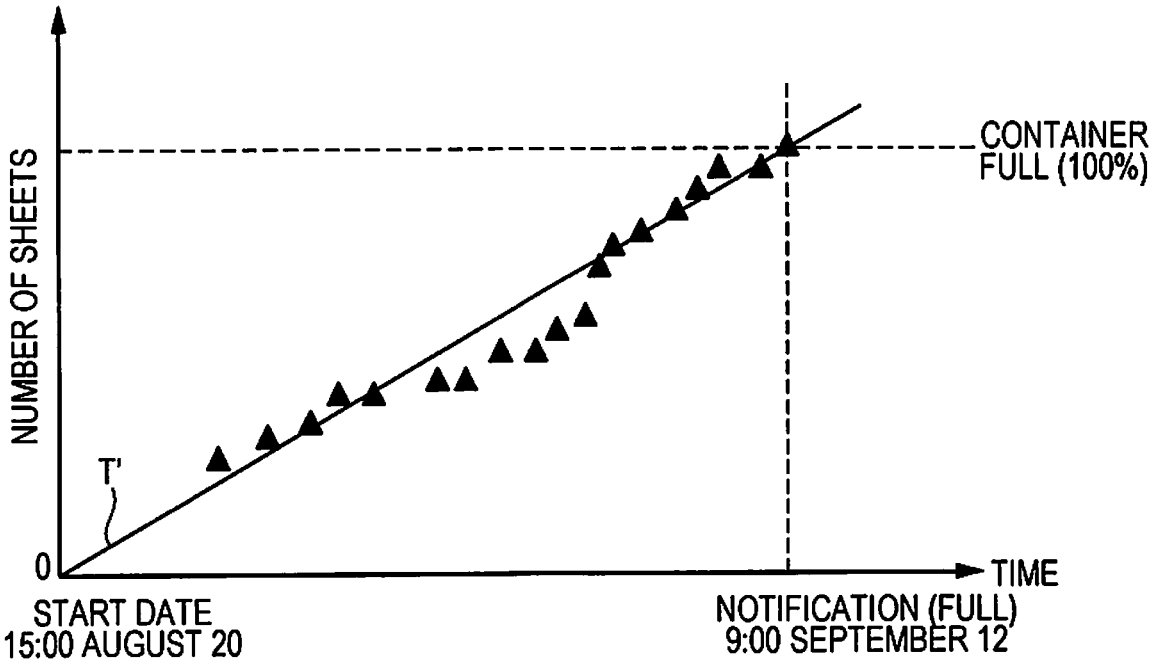
FIG. 14 is a schematic diagram illustrating a notification process (full) according to the first embodiment.

In addition, returning to FIG. 8, in step S301, it is determined whether or not the container 401 is full. FIG. 14 is a schematic diagram illustrating the notification process (100%). As shown in FIG. 14, in a case where the container 401 reaches full (100%) (YES), the process transitions to step S302 based on the measurement data ("black triangle" in the drawings) acquired by the measuring portion 220.

Figure 15:
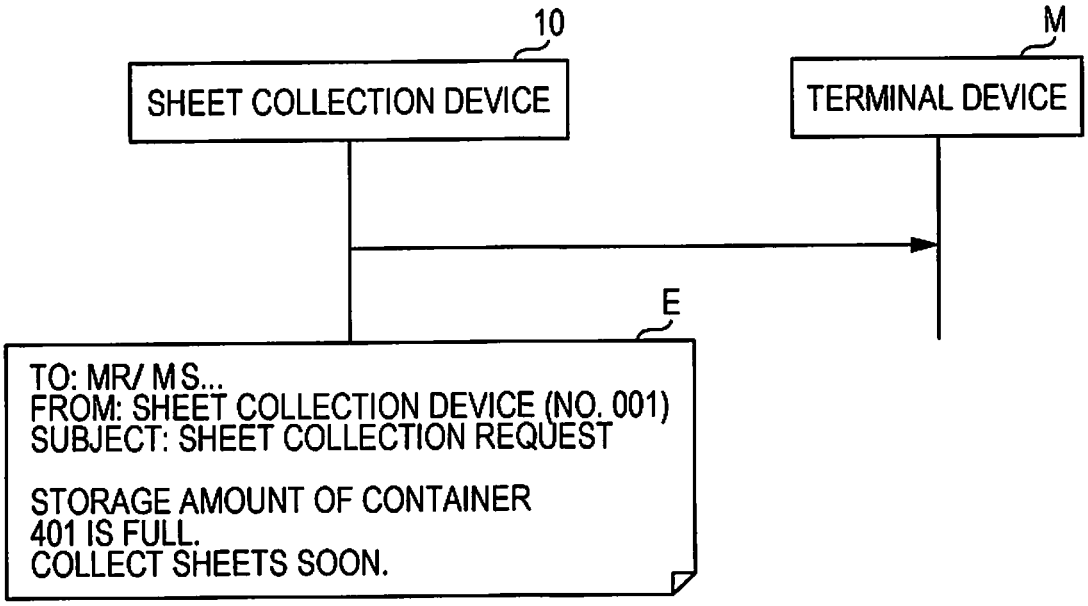
FIG. 15 is a schematic diagram illustrating a notification example of the notification process (full) according to the first embodiment.

In step S302, the notification process toward the terminal device M is executed in which the container 401 becomes full. FIG. 15 is a schematic diagram illustrating the notification example of the notification process (full). As shown in FIG. 15, an electronic mail E in which an address, the sheet collection device 10 serving as a transmission source, a management number, and the storage amount of the container 401 is full, and the need for collection of the sheets P are clearly specified is created. Then, the created electronic mail E is notified (transmitted) to the terminal device M of the user who has the electronic mail address of the user that is registered in the storage portion. Thereby, the user is able to perform collection work of the sheets P in the container 401.

According to the embodiment described above, it is possible to obtain the effects indicated below.

The sheets P that are transported from the tray 240 have the type specified based on the detection data that is detected by the type detection portion 210, and are stored in each container 301, 401, and 501 that is disposed in each type of sheet P. Thereby, work is saved for the user sorting the sheets P in each type. In addition, it is possible to prevent occurrence of mis-sorting.

Furthermore, notification (electronic mail E) and the like in which the collection date and time of the sheets P is predicted is transmitted to the terminal device M of the user from the sheet collection device 10, therefore the user is able to know the state of the storage amount of the sheets P in the containers 301, 401, and 501 or a collection timing, and it is possible to reduce the workload.

Second Embodiment

Figure 16:
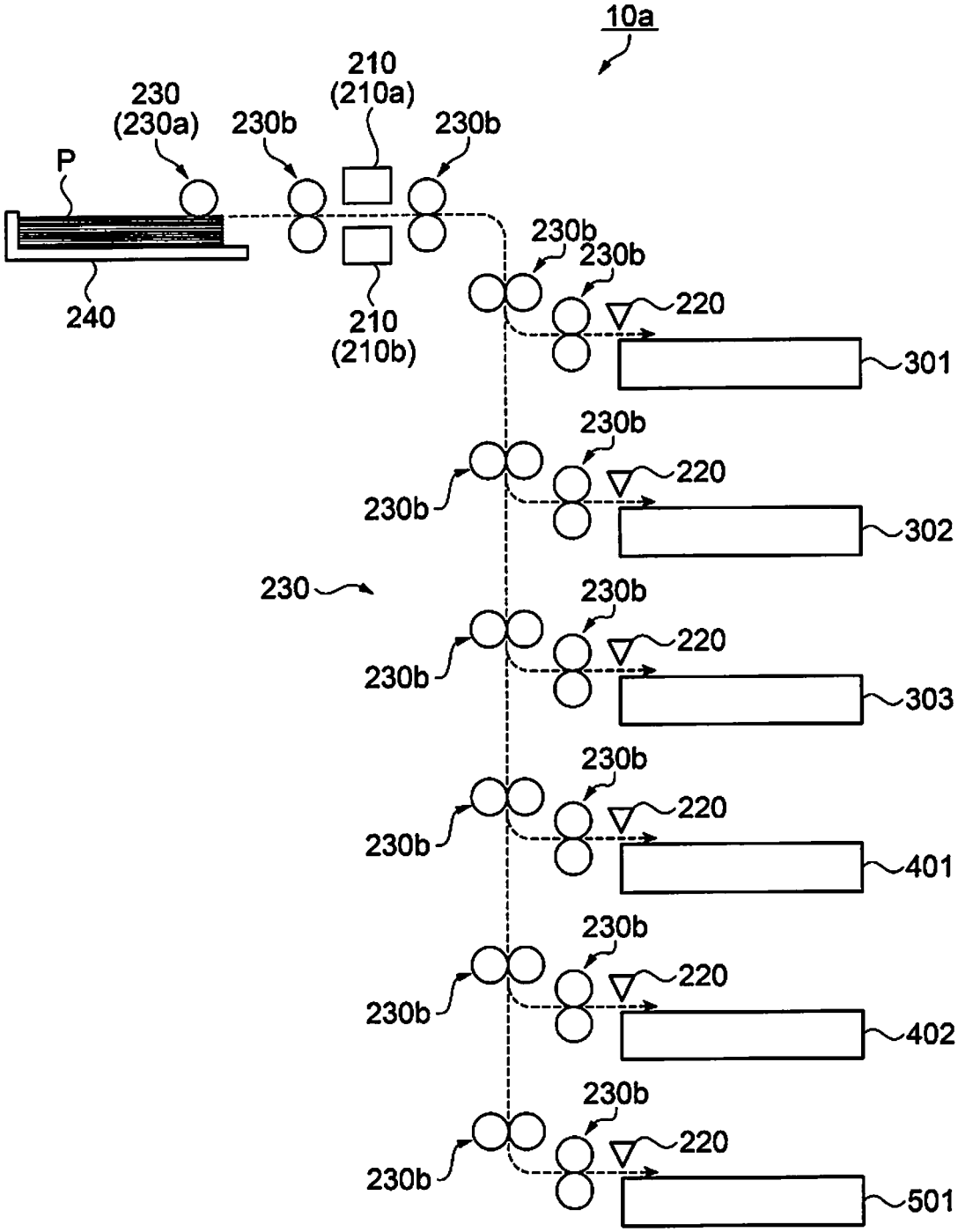
FIG. 16 is a schematic diagram illustrating a configuration of a sheet collection device according to a second embodiment.
Figure 17:
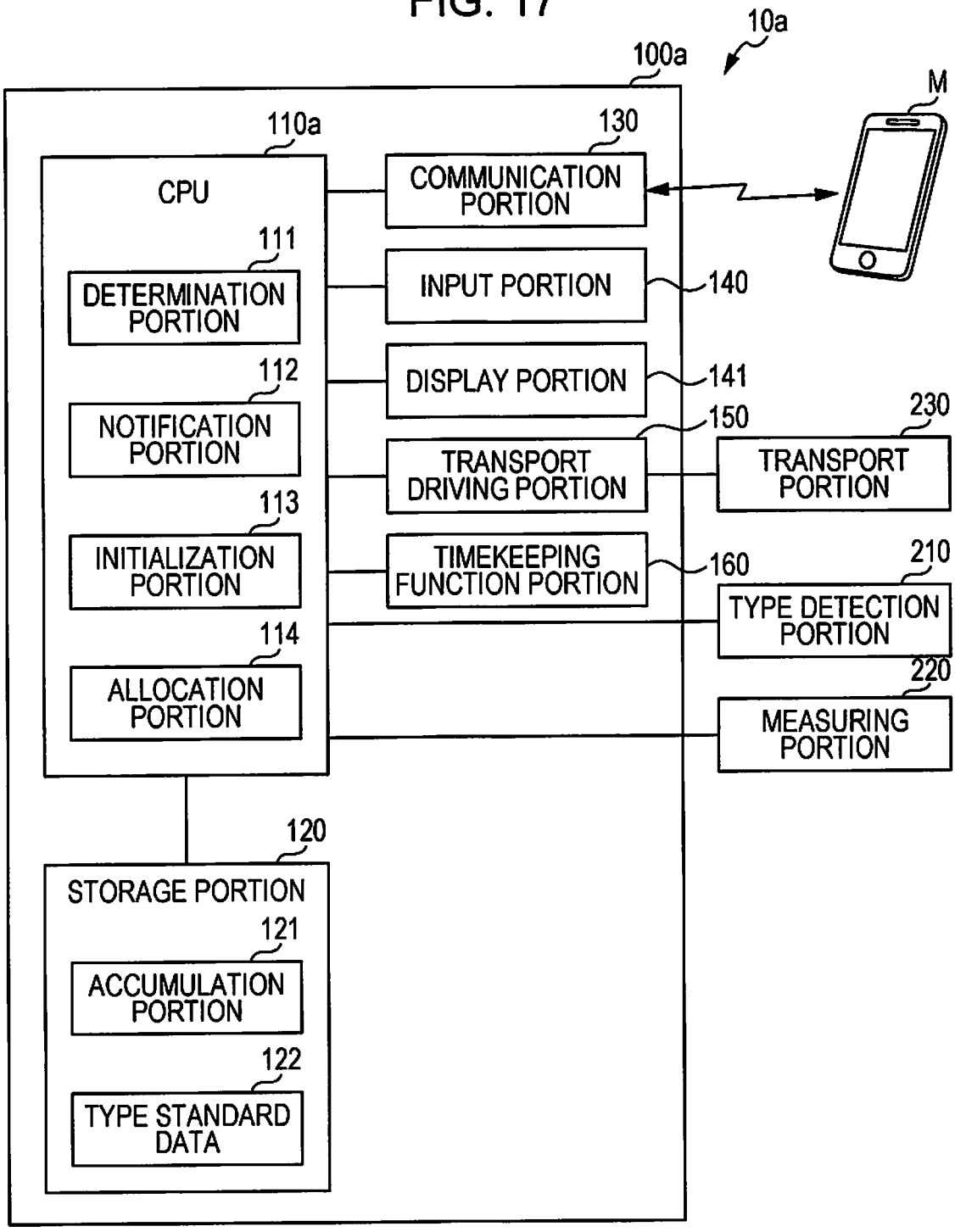
FIG. 17 is a block diagram illustrating a configuration of the sheet collection device according to the second embodiment.

Next, a second embodiment will be described. FIG. 16 is a schematic diagram illustrating a configuration of the sheet collection device, and FIG. 17 is a block diagram illustrating a configuration of a control portion of the sheet collection device. Note that, in the first embodiment, with respect to the type of sheets P of three kinds, a configuration of a case in which three containers 301, 401, and 501 are disposed, the three kinds of sheets P are transported from the tray 240, and stored in each container 301, 401, and 501 in each type of sheet P, but in the embodiment, with respect to the three kinds of sheets P, a configuration of a case in which four or more containers that is greater than the number of types of the sheets P are disposed, and the number of containers that are stored in each type of the sheets P is allocated is described.

As shown in FIG. 16, a sheet collection device 10*a* is provided with a tray 240 in which sheets P are placed, a transport portion 230 that transports the sheets P from the tray 240, a type detection portion 210 that detects the type of the transported sheets P, a plurality (six in the present embodiment) containers 301, 302, 303, 401, 402, and 501 that store sheets P of each type, a measuring portion 220 that is provided in each container 301, 302, 303, 401, 402, and 501, a control portion 100*a* (refer to FIG. 17), and the like. Note that, since the configuration of the tray 240, the transport portion 230, the type detection portion 210, and the measuring portion 220 are the same as those of the first embodiment, explanation is omitted. In addition, since the configurations of the containers 302, 303, and 402 are the same as those of the containers 301, 401, and 501 according to the first embodiment, explanation is omitted.

As shown in FIG. 17, the control portion 100*a* is provided with a storage portion 120 in which a control program or the like is stored, a CPU 110*a* that executes the control program and controls each portion, a communication portion 130, an input portion 140, a display portion 141, a transport driving portion 150, a timekeeping function portion 160, and the like. Furthermore, in the embodiment, the allocation portion 114 is provided in the CPU 110*a*. Note that, since the configurations other than of the allocation portion 114 are the same as those of the first embodiment, explanation is omitted.

Figure 18:
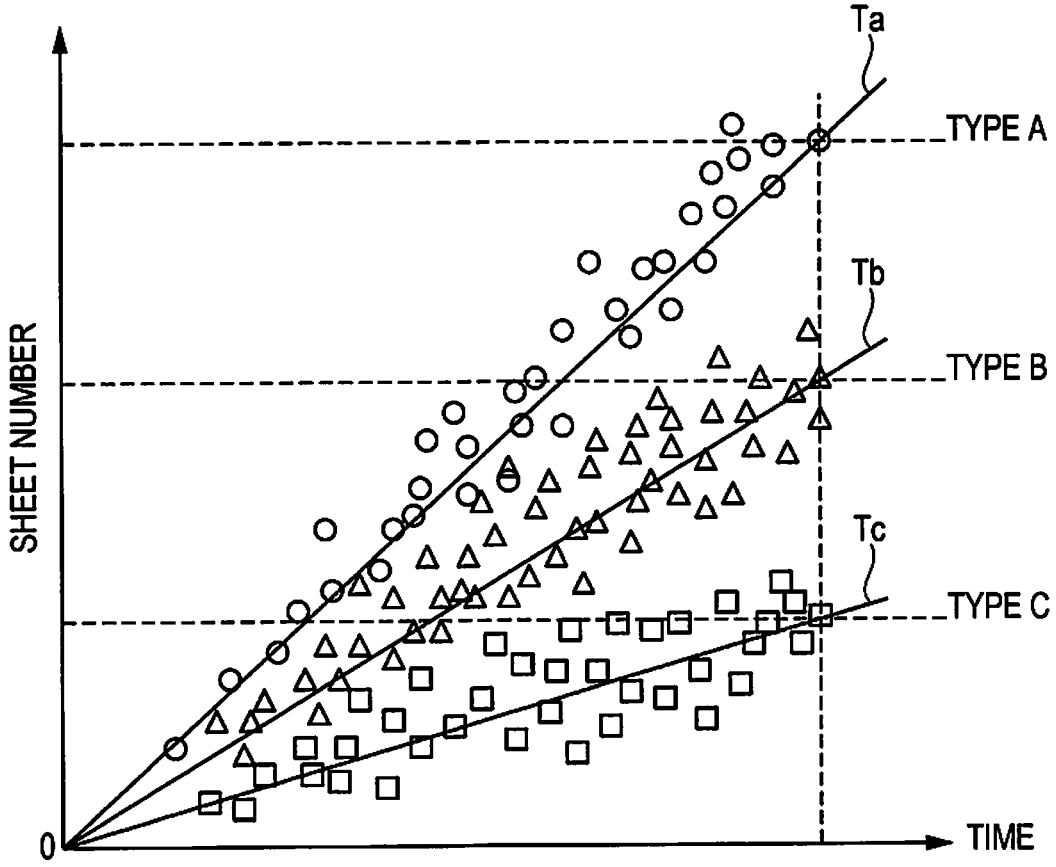
FIG. 18 is an explanatory diagram that explains an allocation method of a container according to the second embodiment.

The allocation portion 114 allocates the type of the sheets P that are stored respectively in the plurality of containers 301, 302, 303, 401, 402, and 501 based on the progress information that is accumulated in the accumulation portion 121. An allocation method for a container will be described below. FIG. 18 is an explanatory diagram that explains the allocation method for a container. Specifically, after the initialization process is performed, an example is indicated of the progress information ("○" indicates type A, "Δ" indicates type B, and "□" indicates type C in the drawings) of the storage amount in each type of the sheets P (three kinds of types A, B, and C in the embodiment). Note that, this information is accumulated by the accumulation portion 121 based on the measurement data of the measuring portion 220.

Then, in the allocation portion 114, a prediction line Ta that is a single regression line of linear function corresponding to type A sheets P is calculated using single regression analysis and the like based on the progress information of the accumulation portion 121. In addition, in the same manner, a prediction line Tb that is a single regression line of linear function corresponding to type B sheets P is calculated, and a prediction line Tc that is a single regression line of linear function corresponding to type C sheets P is calculated. Then, the number of stored containers is allocated according to the proportion of the inclination of the respective single regression lines. In the example of the embodiment, the ratio of the inclination of the type A prediction line Ta, the ratio of the inclination of the type B prediction line Tb, and the ratio of the inclination of the type C prediction line Tc is 3:2:1. Accordingly, out of the six containers 301, 302, 303, 401, 402, and 501, the three containers 301, 302, and 303 are allocated with type A sheets P, the two containers 401 and 402 are allocated with type B sheets P, and the one container 501 is allocated with type C sheets P.

Figure 19:
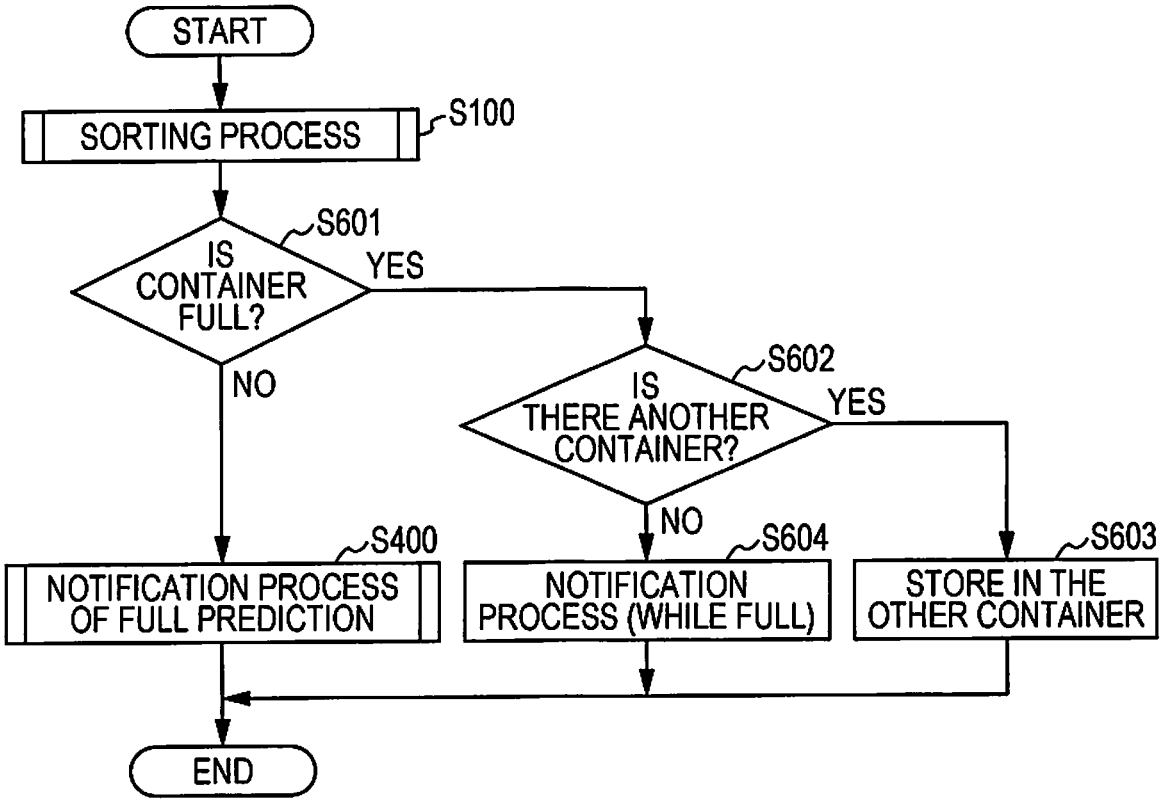
FIG. 19 is a flow chart illustrating the notification process according to the storage amount according to the second embodiment.

Next, the notification process method and the container switching method will be described. FIG. 19 is a flow chart illustrating the notification process according to the storage amount.

As shown in FIG. 19, the notification process according to the storage amount is performed while the sorting process (refer to FIG. 4) is performed in step S100. Then, in step S601, it is determined whether or not the container 301 (401, 501) is full. Specifically, determination is made based on the progress information that is obtained from the accumulation process of the sheets P. Then, in a case where the container is full, the process transitions to step S602, and in a case where the container is not full (NO), the process transitions to step S400 and the notification process of full predication is performed.

Next, in step S602, it is determined whether or not there is another container. For example, in a case of type B sheets P, there is another container 402 even in a case where the container 401 is full. In this case, it is determined that there are other containers (YES), the process transitions to step S603, and in step S603, the transport portion 230 is controlled and the sheets P are stored in another container. Note that, in step S602, in a case where it is determined that there are no other containers (NO), the process transitions to step S604, and the notification process toward the terminal device M is executed in which the container is full.

According to the embodiment described above, it is possible to obtain the effects indicated below.

The number of containers 301, 302, 303, 401, 402, and 501 is appropriately allocated according to the storage amount of each type of the sheets P, therefore it is possible to more efficiently perform storage of the sheets P.

Third Embodiment

Next, a third embodiment will be described. Note that, in the embodiment, an aspect of a sheet collection system that includes a host device will be described. The sheet collection system of the embodiment is a system including a sheet collection device and a host device that is connected to the sheet collection device, in which the sheet collection device has a discrimination portion that discriminates the type of sheet, a plurality of containers that store sheets, and a transport portion that transports the sheets to any one container from among the plurality of containers based on the discrimination result by the discrimination portion, and the host device has an accumulation portion that accumulates progress information of a storage amount of sheets in the container, and a notification portion that predicts a time at which the storage amount of the sheets that are stored in the container based on the progress information reaches a first predetermined amount and notifies the predicted time to a terminal device.

Figure 20:
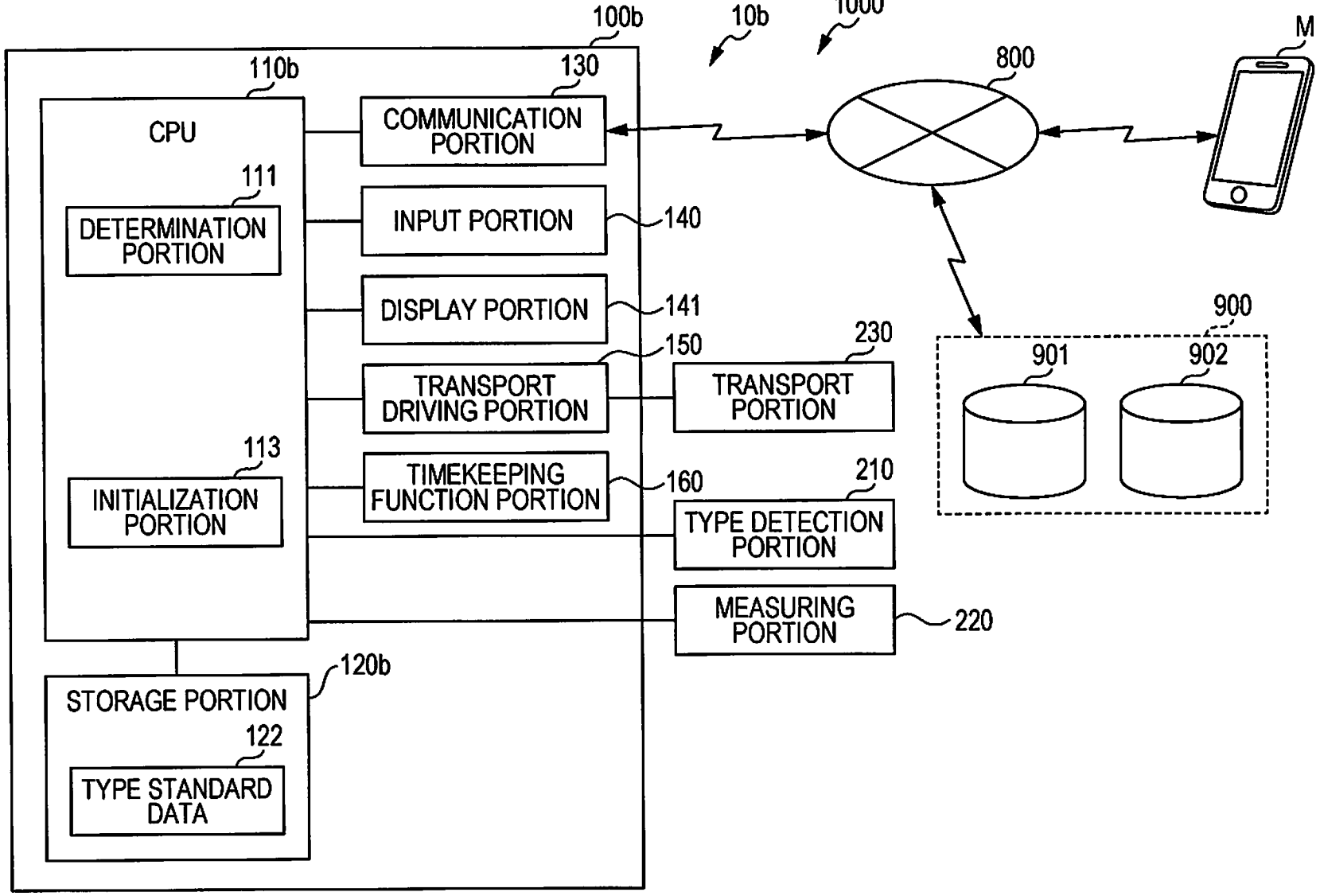
FIG. 20 is a schematic diagram illustrating a configuration of a sheet collection system according to a third embodiment.

FIG. 20 is a schematic diagram illustrating a configuration of a sheet collection system. As shown in FIG. 20, a sheet collection system 1000 has a sheet collection device 10*b* and a server device 900 as a host device that is connected to be able to connect with the sheet collection device 10*b*. The sheet collection device 10*b* and the server device 900 are connected to be able to communicate via a communication circuit 800. In addition, the terminal device M of the user is connected to be able to communicate with the server device 900 via the communication circuit 800. Note that, in the sheet collection system 1000 of the embodiment, an example is indicated in which one (one device) sheet collection device 10*b* is connected to the communication circuit 800, but is not limited to this configuration, and there may be a configuration in which a plurality of sheet collection devices 10*b* are connected to the communication circuit 800, and each sheet collection device 10*b* is able to communicate with the server device 900. In addition, in the same manner for the terminal device M, there is a configuration in which a plurality of terminal devices M are able to connect with the communication circuit 800.

The sheet collection device 10*b* is provided with a control portion 100*b*, a type detection portion 210 that is connected with the control portion 100*b*, a measuring portion 220, a transport portion 230, and the like. Note that, since the configuration of the type detection portion 210, the measuring portion 220, the transport portion 230, and the like are the same as those of the first embodiment, explanation is omitted (refer to FIG. 1).

The control portion 100*b* is provided with a storage portion 120*b* in which a control program or the like is stored, a CPU 110*b* that executes the control program and controls each portion, a communication portion 130, an input portion 140, a display portion 141, a transport driving portion 150, a timekeeping function portion 160, and the like. Note that, since the configuration of each portion is the same as that of the first embodiment, explanation is omitted.

The server device 900 is provided with an accumulation portion 901 and a notification portion 902. The accumulation portion 901 accumulates progress information of the storage amount of the sheets P in the containers, and the details are the same as the configuration of the accumulation portion 121 of the first embodiment. The notification portion 902 predicts a time at which the storage amount of the sheets P that are stored in the containers based on the progress information of the accumulation portion 901 reaches a first predetermined amount and notifies the predicted time to the terminal device M. Accordingly, in the notification process of the first embodiment, the sheet collection device 10 creates an electronic mail and transmits the electronic mail E to the terminal device M, but in the embodiment, the electronic mail E is transmitted to the terminal device M from the notification portion 902 of the server device 900 based on an instruction of the sheet collection device 10*b*. Note that, since the content of other details of the notification process is the same as that of the first embodiment, explanation is omitted.

According to the embodiment described above, it is possible to obtain the effects indicated below.

In the same manner as in the first embodiment, it is possible to omit work by the user for sorting the sheets P into each type and prevent the occurrence of mis-sorting. In addition, notification (electronic mail E) in which the collection date and time and the like of the sheets P is predicted is transmitted to the terminal device M of the user from the server device 900, therefore the user is able to know the state of the storage amount of the sheets P in the containers 301, 401, and 501 or a collection timing, and it is possible to reduce the workload. Furthermore, it is possible to simplify the configuration of the sheet collection device 10*b* since the accumulation portion 901 and the notification portion 902 are disposed in the server device 900.

The invention is not limited to the embodiment described above and it is possible to add various modifications, improvements, or the like to the embodiment described above. Modification examples are described below.

(Modification Example 1) In the embodiments, the storage amount of the sheets P is the number of sheets of the sheets P, but is not limited to this. For example, the storage amount of the sheets P may be weight. In this case, the measuring portion 220 that measures the weight in each container 301, 401, and 501 may be provided. By doing so, it is possible to obtain the effects in the same manner as above.

(Modification Example 2) In the notification process according to the embodiments, there is a configuration in which the electronic mail E, having content such as collection date and time, is transmitted to the terminal device M, but is not limited to this. For example, there may be a configuration in which notification is made in which the collection prediction date and time are input into a scheduler of the terminal device M in the notification process. By doing this, it is possible to improve work efficiency without the need for the user to confirm the collection data and time and the like every time the electronic mail E is transmitted.

(Modification Example 3) In the embodiments, there is a configuration in which the sheets P are sorted into each type and stored and collected in the containers 301, 401, and 501, but there may be a configuration in which the sheets P that are suitable for recycling collection and the sheets P that are not suitable for recycling collection are sorted in discrimination of the type of the sheets P. By doing so, it is possible to reduce occurrence of mis-sorting of the user.

REFERENCE SIGNS LIST

10, 10*a*, 10*b* SHEET COLLECTION DEVICE
100, 100*a*, 100*b* CONTROL PORTION
110, 110*a*, 110*b* CPU
111 DETERMINATION PORTION
112 NOTIFICATION PORTION
113 INITIALIZATION PORTION
114 ALLOCATION PORTION
121 ACCUMULATION PORTION
160 TIMEKEEPING FUNCTION PORTION
210 TYPE DETECTION PORTION
220 MEASURING PORTION
230 TRANSPORT PORTION
230*a* PICKUP ROLLER
230*b* PAIR OF ROLLERS
301, 302, 303, 401, 402, 501 CONTAINER
800 COMMUNICATION CIRCUIT
900 SERVER DEVICE AS HOST DEVICE
901 ACCUMULATION PORTION
902 NOTIFICATION PORTION
1000 SHEET COLLECTION SYSTEM
P SHEET

The invention claimed is:

1. A sheet collection device comprising:

a discrimination portion that discriminates at least one or more of whether or not each of sheets is an A4 size sheet, whether or not each of the sheets is a fine quality paper, whether or not each of the sheets is a carbon paper, or whether or not each of the sheets is a vinyl coated paper;

a plurality of containers that store the sheets;

a transport portion that transports the sheets to any one container from among the plurality of containers based on the discrimination result by the discrimination portion;

an accumulation portion that accumulates progress information of a storage amount of sheets in the containers;

a notification portion that predicts a time at which the storage amount of the sheets that are stored in the containers reaches a first predetermined amount based on the progress information and notifies the predicted time to a terminal device; and an initialization portion that initializes the storage amount of sheets that are stored in the containers to zero, in response to initialization of the storage amount of the sheets in at least one of the containers to zero at the initialization portion, the notification portion predicting the time at which the storage amount of the sheets to be stored in the at least one of the containers reaches the first predetermined amount, based on the progress information that has been accumulated for the storage amount of the sheets in the at least one of the containers before the initialization, and notifying the predicted time to the terminal device.

2. The sheet collection device according to claim 1, further comprising:

a measuring portion that measures that the storage amount of sheets that are stored in the containers reaches a second predetermined amount, wherein the notification portion notifies the predicted time when the storage amount of sheets that are stored in the containers reaches the second predetermined amount.

3. The sheet collection device according to claim 1, wherein the accumulation portion accumulates progress information of the storage amount of sheets in the containers for each type of the sheets, and the sheet collection device further comprises an allocation portion that allocates the type of the sheets that are stored respectively in the plurality of containers based on the progress information that is accumulated in the accumulation portion.

4. A sheet collection system including a sheet collection device and a host device that is connected to the sheet collection device, wherein the sheet collection device includes a discrimination portion that discriminates at least one or more of whether or not each of sheets is an A4 size sheet, whether or not each of the sheets is a fine quality paper, whether or not each of the sheets is a carbon paper, or whether or not each of the sheets is a vinyl coated paper, a plurality of containers that store the sheets, a transport portion that transports the sheets to any one container from among the plurality of containers based on the discrimination result by the discrimination portion, and an initialization portion that initializes a storage amount of sheets that are stored in the containers to zero, and the host device includes an accumulation portion that accumulates progress information of the storage amount of sheets in the containers, and a notification portion that predicts a time at which the storage amount of the sheets that are stored in the containers reaches a first predetermined amount based on the progress information and notifies the predicted time to a terminal device, and in response to initialization of the storage amount of the sheets in at least one of the containers to zero at the initialization portion, the notification portion predicts the time at which the storage amount of the sheets to be stored in the at least one of the containers reaches the first predetermined amount, based on the progress information that has been accumulated for the storage amount of the sheets in the at least one of the containers before the initialization, and notifies the predicted time to the terminal device.

5. A sheet collection method comprising:

discriminating at least one or more of whether or not each of sheets is an A4 size sheet, whether or not each of the sheets is a fine quality paper, whether or not each of the sheets is a carbon paper, or whether or not each of the sheets is a vinyl coated paper;

transporting the sheets to any one container from among a plurality of containers that store the sheets based on the discrimination result;

accumulating progress information of a storage amount of sheets in the containers;

predicting a time at which the storage amount of the sheets that are stored in the containers reaches a first predetermined amount based on the progress information and notifying the predicted time to a terminal device; and initializing the storage amount of sheets that are stored in the containers to zero, wherein in response to initializing of the storage amount of the sheets in at least one of the containers to zero, the time at which the storage amount of the sheets to be stored in the at least one of the containers reaches the first predetermined amount is predicted based on the progress information that has been accumulated for the storage amount of the sheets in the at least one of the containers before the initializing, and the predicted time is notified to the terminal device.

* * * * *